US009907421B2

(12) United States Patent
Carson

(10) Patent No.: US 9,907,421 B2
(45) Date of Patent: Mar. 6, 2018

(54) CONTAINER INSULATING AND COOLING SYSTEM

(71) Applicant: Robert V. Carson, Camarillo, CA (US)

(72) Inventor: Robert V. Carson, Camarillo, CA (US)

( * ) Notice: Subject to any disclaimer, the term of this patent is extended or adjusted under 35 U.S.C. 154(b) by 29 days.

(21) Appl. No.: 14/990,939

(22) Filed: Jan. 8, 2016

(65) Prior Publication Data

US 2017/0196388 A1 Jul. 13, 2017

(51) Int. Cl.
*B65D 6/40* (2006.01)
*A47G 23/02* (2006.01)

(52) U.S. Cl.
CPC .. *A47G 23/0216* (2013.01); *A47G 2023/0291* (2013.01)

(58) Field of Classification Search
CPC ..... A47G 23/0216; A47G 19/2288; A47G 2023/0283; Y10S 220/903; Y10S 428/913; B65D 81/3886; B65D 81/3895; B65D 81/3897
USPC ..... 220/737
See application file for complete search history.

(56) References Cited

U.S. PATENT DOCUMENTS 4,183,226 A 1/1980 Moore
4,293,015 A * 10/1981 McGough ..... B65D 81/3886 150/901
4,908,248 A * 3/1990 Nakashima ..... A61F 7/10 383/37
5,269,368 A * 12/1993 Schneider ..... A47J 36/24 165/135
5,975,336 A * 11/1999 Hart ..... B65D 81/18 220/592.16
6,123,217 A 9/2000 Miller
6,269,654 B1 * 8/2001 Murray ..... B32B 3/04 62/457.1
6,425,494 B1 7/2002 Woods, II
8,117,677 B2 * 2/2012 Toth ..... A42B 3/121 2/413
9,591,937 B2 * 3/2017 Fu ..... B29C 44/1233
2004/0084461 A1 * 5/2004 Eisenbraun ..... B60N 3/108 220/739

FOREIGN PATENT DOCUMENTS

WO WO1992004256 3/1992

* cited by examiner

*Primary Examiner* — Shawn M Braden

(57) ABSTRACT

A container insulating and cooling system includes a perimeter wall having an upper edge and a lower edge. The perimeter wall has an inner surface and an outer surface. The upper edge defines an opening extending into the perimeter wall. A plurality of cells is attached to the inner surface of the perimeter wall. Each of the cells is comprised of a water permeable and flexible material. The cells each have an absorbent material therein that expands when hydrated such that the absorbent material fills and expands the cells. The cells are hydrated and frozen such that the cells are abuttable against a container to cool the container.

13 Claims, 8 Drawing Sheets

CONTAINER INSULATING AND COOLING SYSTEM

BACKGROUND OF THE DISCLOSURE

Field of the Disclosure

The disclosure relates to container insulating devices and more particularly pertains to a new container insulating device for retaining a container in cooled or warmed condition.

SUMMARY OF THE DISCLOSURE

An embodiment of the disclosure meets the needs presented above by generally comprising a perimeter wall having an upper edge and a lower edge. The perimeter wall has an inner surface and an outer surface. The upper edge defines an opening extending into the perimeter wall. A plurality of cells is attached to the inner surface of the perimeter wall. Each of the cells is comprised of a water permeable and flexible material. The cells each have an absorbent material therein that expands when hydrated such that the absorbent material fills and expands the cells. The cells are hydrated and frozen such that the cells are abuttable against a container to cool the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
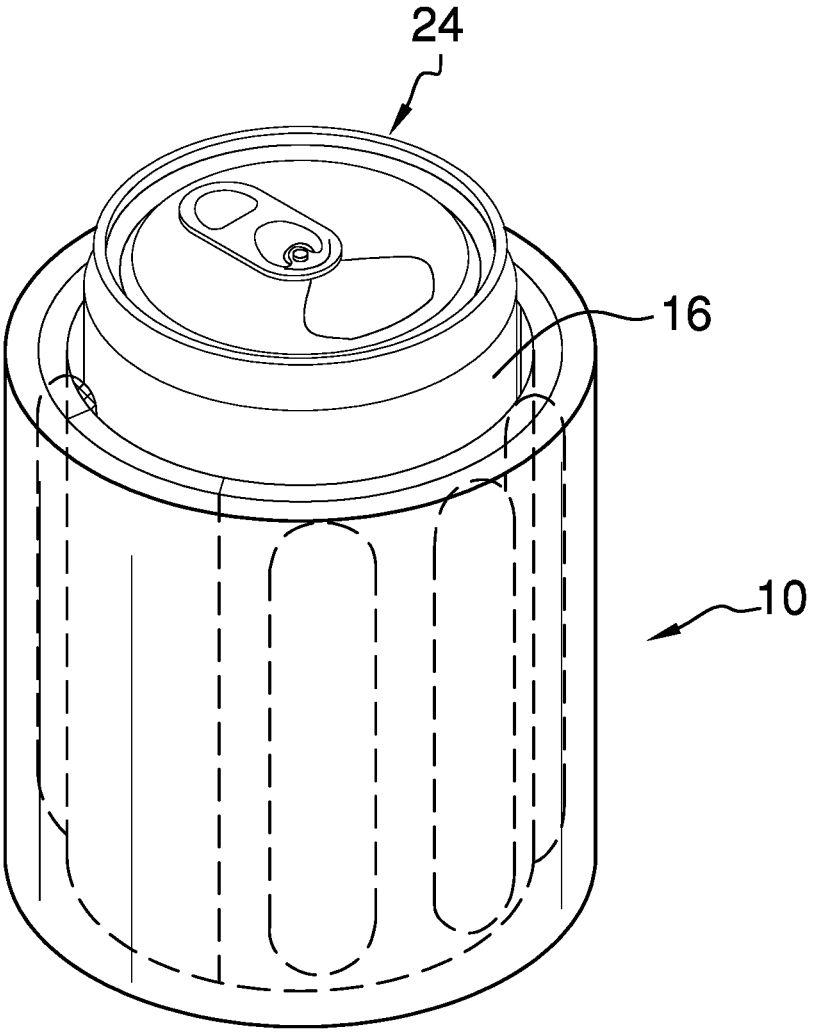
FIG. 1 is a top perspective view of a container insulating and cooling system according to an embodiment of the disclosure.

With reference now to the drawings, and in particular to FIGS. 1 through 10 thereof, a new container insulating device embodying the principles and concepts of an embodiment of the disclosure and generally designated by the reference numeral 10 will be described.

As best illustrated in FIGS. 1 through 10, the container insulating and cooling system 10 generally comprises a covering 12 for a container 14 to insulate the container 14 from changes in a desired temperature as well as specifically remove heat from the container 14. However, the system 10, as will be discussed below, may also be used to add heat to the container 14. Depending on the configuration of the system 10, the container 12 may be any container 14 and in particularly one used for holding beverages such as bottles, cans and the like. However, the system 10 may be used with virtually any other container 14 where the user would like the container 14 to be retained in a cold state, such as kegs, bottles, cups, glassware, jugs, growlers or other containers. The container 14, however, may be particularly suited to the system 10 and include a peripheral wall 16 having a plurality of indentations 18 therein for reasons which will be described below.

Figure 2:
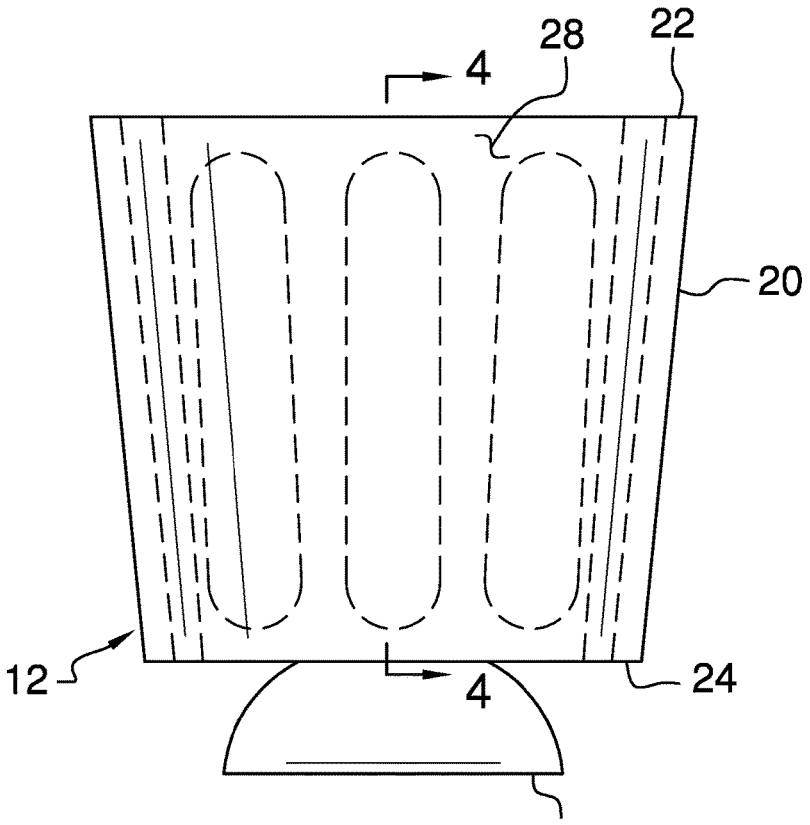
FIG. 2 is a front view of an embodiment of the disclosure.
Figure 3:
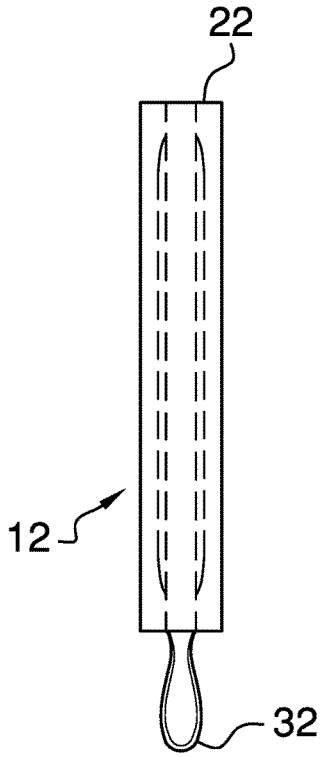
FIG. 3 is a side view of an embodiment of the disclosure.
Figure 4:
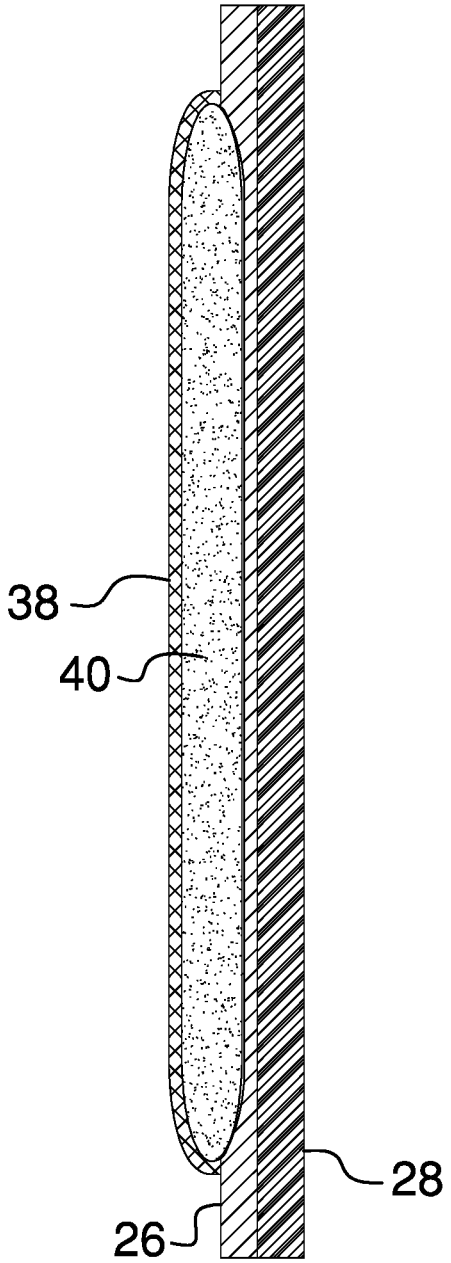
FIG. 4 is a cross-sectional view of an embodiment of the disclosure taken along line 4-4 of FIG. 2.
Figure 5:
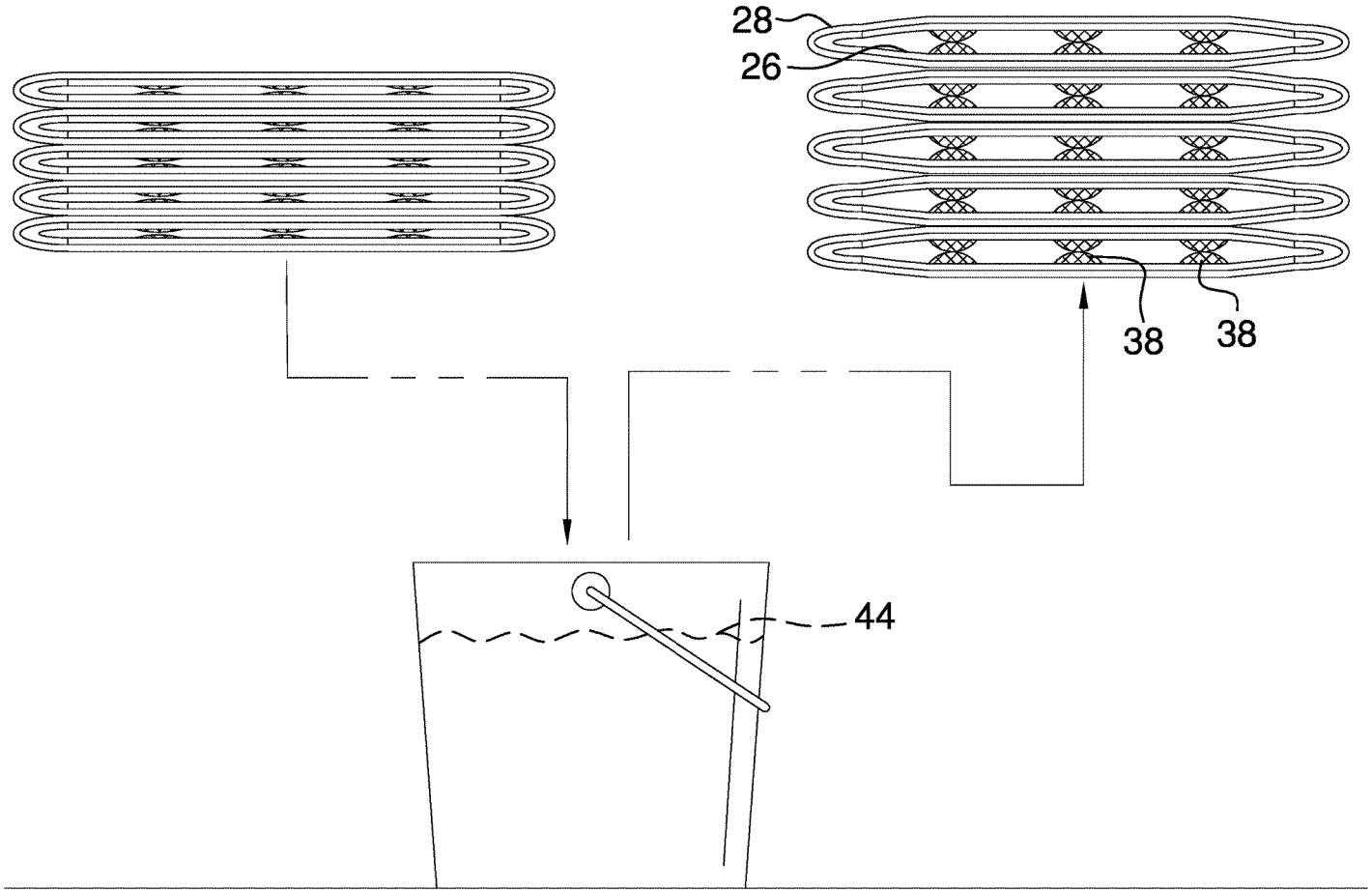
FIG. 5 is an in-use view of an embodiment of the disclosure.
Figure 6:
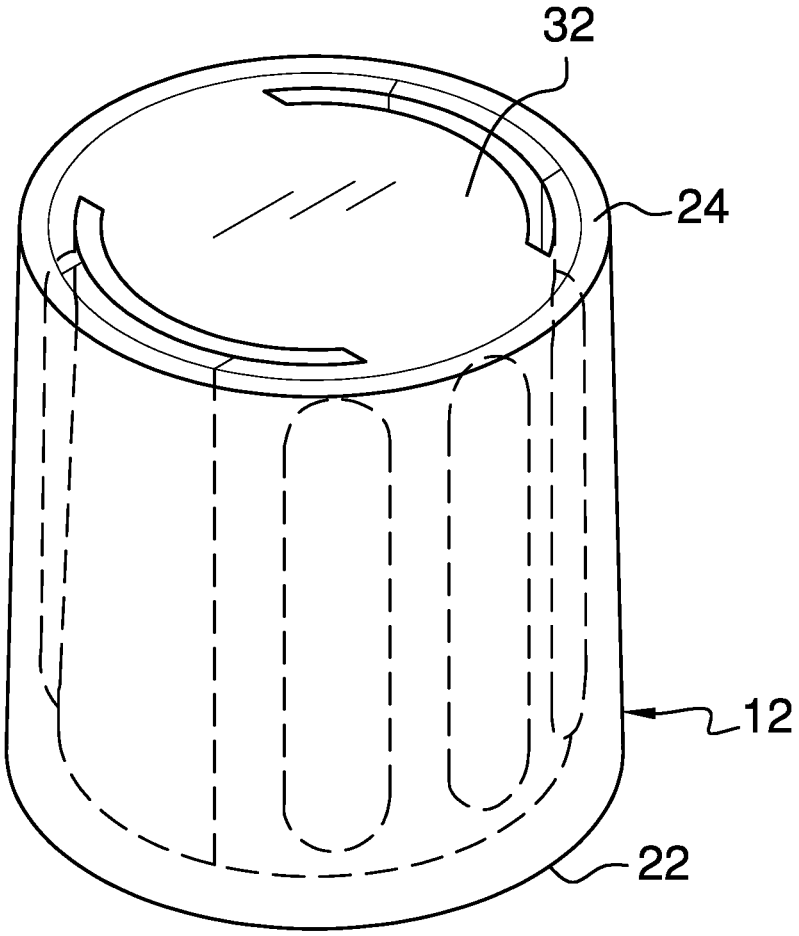
FIG. 6 is a bottom view of an embodiment of the disclosure.
Figure 7:
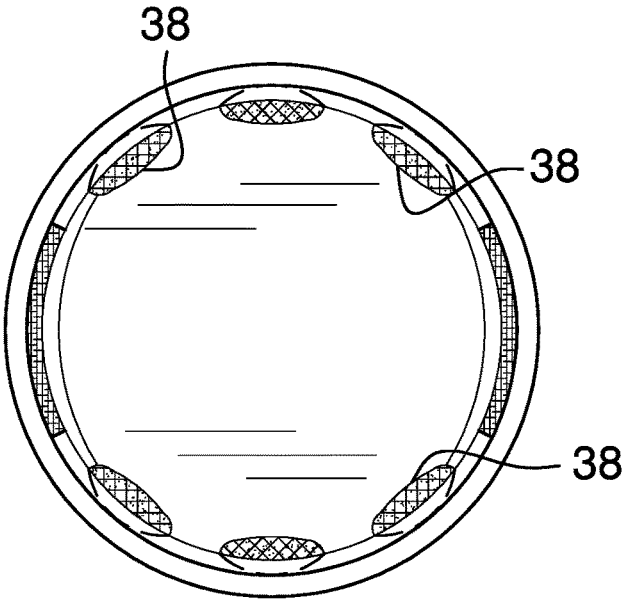
FIG. 7 is a top view of an embodiment of the disclosure.
Figure 8:
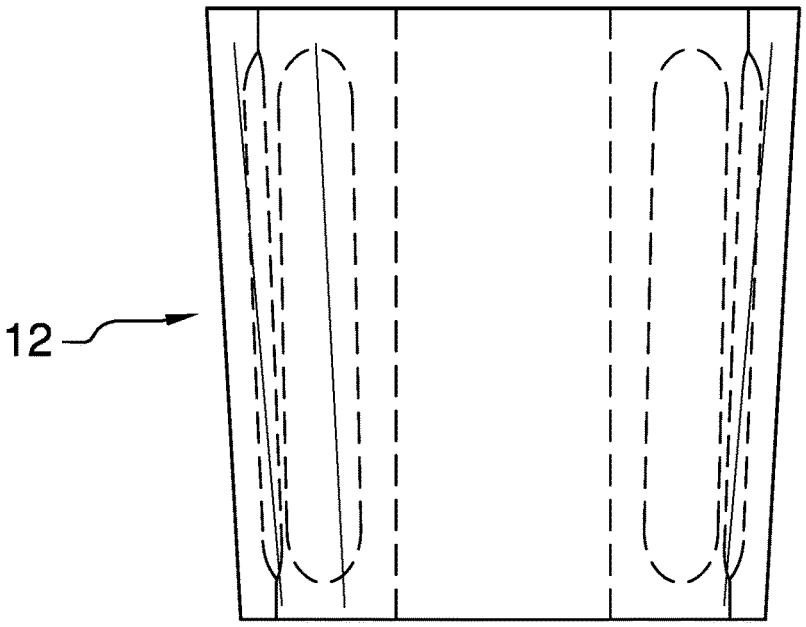
FIG. 8 is a front view of an embodiment of the disclosure.
Figure 9:
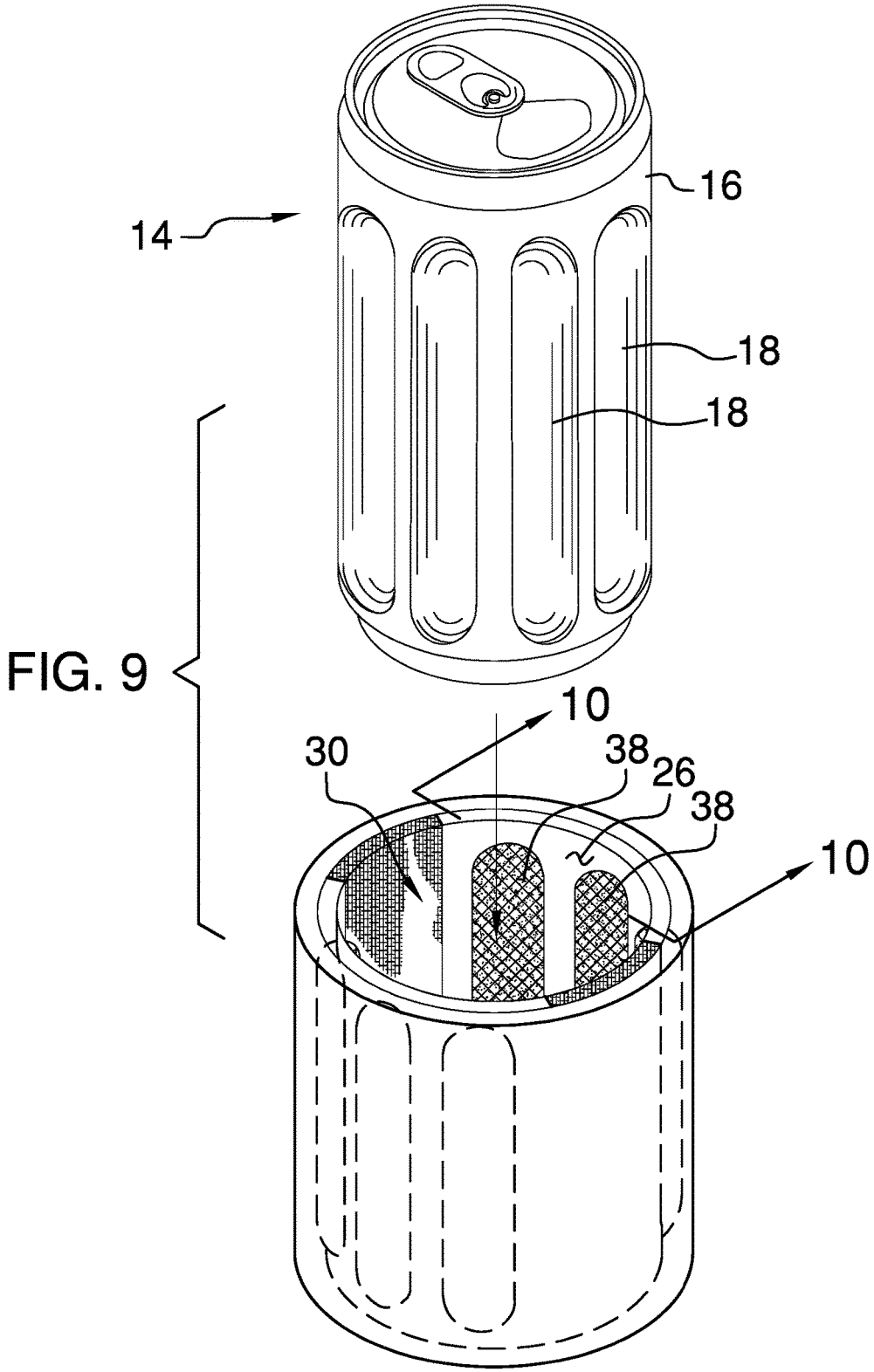
FIG. 9 is a perspective top view of an embodiment of the disclosure.

The covering 12 includes a perimeter wall 20 that has an upper edge 22 and a lower edge 24. The perimeter wall 20 has an inner surface 26 and an outer surface 28. The upper edge 22 defines an opening 30 extending into an area bounded by the perimeter wall 20. A bottom wall 32 may be attached to the lower edge 24 of the perimeter wall. As shown in FIGS. 2 and 3, the bottom wall 32 may only be partially attached to the lower edge 24 to allow for folding of the bottom wall 32 during storage of the covering 12. However, the bottom wall 32 may be provided that co-extensive with the lower edge 24.

The perimeter wall 20 comprises a flexible material which, more particularly, may comprise a resiliently stretchable material. This will allow the perimeter wall 20 to conform to the size and shape of the container 14 on which it is being positioned. Alternate variations may be utilized including the usage of a plurality of sections of the perimeter wall 20 which would include non-flexible sections and resiliently stretchable sections. Another variation may include the perimeter wall having break therein extending through the upper 22 and lower 24 edges and a closure used to releasably close the break. The closure may include a hook and loop closure, zipper, snaps and the like.

The perimeter wall 20 may include at least one layer 34 comprising an insulating material. The perimeter wall 20 may include a plurality of layers 34, 36 wherein one layer 36 is provided that is water resistant to prevent fluids from wicking through the perimeter wall 20. The water resistant layer 36 and the insulating layer 34 may comprise the same layer. Insulating and water resistant properties of the perimeter wall 20 will ensure that a user of the system 10 will be able to comfortable grip the covering 12.

The inner surface 26 of the perimeter wall includes one or more cells 38. The cells 38 may be positioned within in an innermost layer of the perimeter wall 20 or simply attached to the inner surface 26. Each of the cells 26 is comprised of a water permeable and flexible material to allow water to flow into the cells 26 and therefore the cells 26 may be comprised of a mesh material. Each of the cells 38 has an absorbent material 40 therein. The absorbent material 40 expands when hydrated to such that the absorbent material fills 40 and expands the cells 38. The absorbent material 40 may comprise any material that readily absorbs water and increases in size several times. One class of such materials are super absorbent polymers which are known to increase their size by greater than 50 times. Other materials, such as sodium bentonite may be used which swell at approximately 12-15 times their original size. Additional materials such as food starches may also be used due to their expansion properties. Materials such as sodium bentonite may have some advantages for reusability since they may be dehydrated easily and thereafter be hydrated again. Essentially, any material may be used which absorbs large quantities of water and increase size at least 300%. It should be noted that a single cell 38 may be provided which covers a portion of inner surface 26 or covers the entirety of the inner surface 26.

Figure 10:
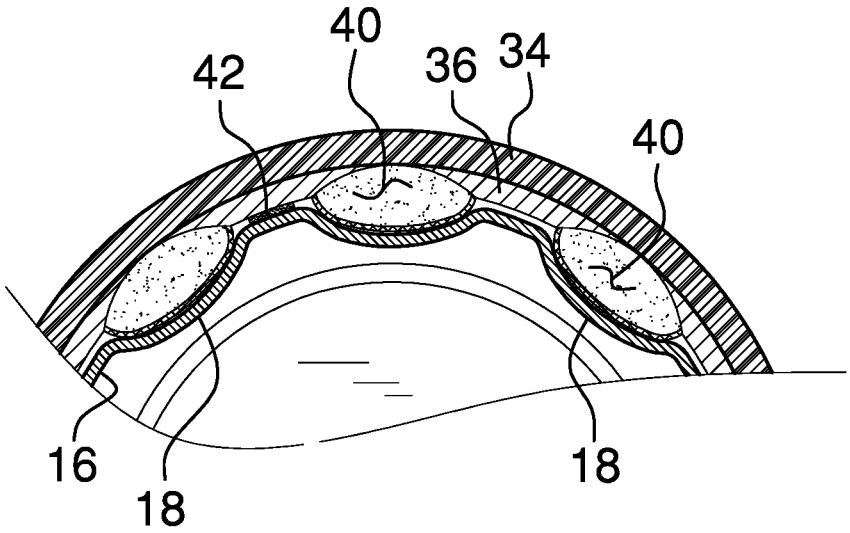
FIG. 10 is a cross-sectional view of an embodiment of the disclosure taken along line 10-10 of FIG. 9.

Should the container 14 include indentations 18, the cells 38 will be positioned so that each is aligned with one of the indentations 18. Though the indentations 18 and cells 38 are each shown as elongated vertically, they may be horizontally orientated instead or have any suitable geometric shape which may include decorative shapes. The cells 38 expand into an aligned one of the indentations 18 such that the perimeter wall 20 is secured to the container 14. This prevents the covering 12 from rotation with respect to the container 14. Alternatively, or in addition to the combination of the cells 38 and indentations 18, adhesive 42 may be positioned on the inner surface 26 to adhesively secure the inner surface 26 to the container 14. The adhesive 42 may be positioned at one or more points on the inner surface 26 and may be positioned between the cells 38 as shown in FIG. 10.

In use, the covering 12 is placed in water 44 so that the absorbent material absorbs the water and expands which in turn expands the cells. The cells 38, by expanding will push outwardly and frictionally engage the container 12 to retain the covering 12 on the container 14. However, the covering 12, before being placed on the container 14, may be placed in an environment that freezes the water 44 in the cells 38. Thus frozen, the cells 38 when placed the container 14, will chill the container 14 or retain the container 14 in a chilled condition. After hydration of the absorbent material, the covering 12 may be placed on the container 14 and the container 14 and covering 12 each placed in a cooled environment, such as a refrigerator, so that the absorbent material and the container 14 are both cooled. Thereafter, when the container 14 is removed from the refrigerator, the covering 12 will help retain the container 14 in a cooled condition. Because the perimeter wall 16 is stretchable, the covering 12 will readily conform to the shape of the container 14 on which it is positioned.

Furthermore, it should be understood that the absorbent material 40 may instead be filled with heated water or hydrated and then heated to retain the container 14 in a warmed condition. Moreover, one or more of the coverings 12 may be placed in water at a selected temperature and to retain a container 14 at that selected temperature. For example, a plurality of coverings 12 may be placed in an ice water bath and then removed as needed to receive a container to cool the container. The covering 12 may be utilized as a label wrapper for the container 14 that will also effectively retain the container at the selected temperature. Thus, the covering 12 may be hydrated after it has already received the container 14 and thereafter hydrated and cooled or hydrated with water of a selected temperature.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A container cooling system comprising:

a container having a peripheral wall, said peripheral wall having a plurality of indentations therein;

a perimeter wall having an upper edge and a lower edge, said perimeter wall having an inner surface and an outer surface, said upper edge defining an opening extending into an area bounded by said perimeter wall; and said inner surface including a plurality of cells, each of said cells being aligned with one of said indentations, each of said cells being comprised of a water permeable and flexible material, each of said cells having an absorbent material therein, said absorbent material expanding when hydrated to such that said absorbent material fills and expands said cells, said cells expanding into an aligned one of said indentations such that said perimeter wall is secured to said container.

2. The container cooling system according to claim 1, wherein said perimeter wall comprises a flexible material.

3. The container cooling system according to claim 2, wherein said flexible material comprises a resiliently stretchable material.

4. The container cooling system according to claim 3, wherein said perimeter wall includes at least one layer comprising an insulating material.

5. The container cooling system according to claim 1, wherein said perimeter wall includes at least one layer comprising an insulating material.

6. The container cooling assembly according to claim 4, further including a bottom wall being attached to said lower edge of said perimeter wall.

7. A container cooling system comprising:

a container having a peripheral wall, said peripheral wall having a plurality of indentations therein;

a perimeter wall having an upper edge and a lower edge, said perimeter wall having an inner surface and an outer surface, said upper edge defining an opening extending into an area bounded by said perimeter wall, said perimeter wall bounding said container, said inner surface being secured to said container with an adhesive; and said inner surface including a plurality of cells, each of said cells being comprised of a water permeable and flexible material, each of said cells having an absorbent material therein, said absorbent material expanding when hydrated such that said absorbent material fills and expands said cells, wherein said cells are configured to be hydrated and frozen such that said cells are abuttable against the container to cool the container, each of said cells being aligned with one of said indentations, said cells expanding when hydrated to move into an aligned one of said indentations.

8. The container cooling system according to claim 7, wherein said perimeter wall comprises a flexible material.

9. The container cooling system according to claim 8, wherein said flexible material comprises a resiliently stretchable material.

10. The container cooling system according to claim 9, wherein said perimeter wall includes at least one layer comprising an insulating material.

11. The container cooling system according to claim 7, wherein said perimeter wall includes at least one layer comprising an insulating material.

12. The container cooling assembly according to claim 10, further including a bottom wall being attached to said lower edge of said perimeter wall.

13. A container cooling system comprising:

a container having a peripheral wall, said peripheral wall having a plurality of indentations therein;

a perimeter wall having an upper edge and a lower edge, said perimeter wall having an inner surface and an outer surface, said upper edge defining an opening extending into an area bounded by said perimeter wall, said perimeter wall bounding said container, said inner surface being secured to said container with an adhesive, said perimeter wall comprising a flexible material, said flexible material comprises a resiliently stretchable material, said perimeter wall including at least one layer comprising an insulating material;

a bottom wall being attached to said lower edge of said perimeter wall; and said inner surface including a plurality of cells, each of said cells being comprised of a water permeable and flexible material, each of said cells having an absorbent material therein, said absorbent material expanding when hydrated such that said absorbent material fills and expands said cells, wherein said cells are configured to be hydrated and frozen such that said cells are abuttable against the container to cool the container, each of said cells being aligned with one of said indentations, said cells expanding when hydrated to move into an aligned one of said indentations.

* * * * *